US008801337B2

(12) United States Patent
Slatter et al.

(10) Patent No.: US 8,801,337 B2
(45) Date of Patent: Aug. 12, 2014

(54) METHOD OF USING A DOME HEADED ROOF BOLT

(71) Applicant: DSI Underground Systems, Inc., Martinsburg, WV (US)

(72) Inventors: Matthew S. Slatter, Salt Lake City, UT (US); Roland C. Walker, Salt Lake City, UT (US)

(73) Assignee: DSI Underground Systems, Inc., Martinsburg, WV (US)

( * ) Notice: Subject to any disclaimer, the term of this patent is extended or adjusted under 35 U.S.C. 154(b) by 0 days.

(21) Appl. No.: 13/847,812

(22) Filed: Mar. 20, 2013

(65) Prior Publication Data

US 2013/0236252 A1 Sep. 12, 2013

Related U.S. Application Data

(63) Continuation of application No. 12/008,500, filed on Jan. 11, 2008, now abandoned.

(51) Int. Cl.

| | |
|---|---|
| ***E21D 20/00*** | (2006.01) |
| ***E21D 21/00*** | (2006.01) |
| ***F16B 35/06*** | (2006.01) |

(52) U.S. Cl.
USPC ..... 405/259.5; 411/402

(58) Field of Classification Search
USPC ..... 405/259.1, 259.5, 259.6, 288, 302.1; 411/402, 403, 337; 52/223.13, 223.14
See application file for complete search history.

(56) References Cited

U.S. PATENT DOCUMENTS

| | | | | |
|---|---|---|---|---|
| 94,601 | A | | 9/1869 | Heywood |
| 1,011,392 | A | | 12/1911 | Thiollier |
| 1,380,424 | A | | 6/1921 | Sessler |
| 2,075,411 | A | | 3/1937 | Von Mertens |
| 2,552,004 | A | | 5/1951 | Erdman |
| 2,829,502 | A | | 4/1958 | Dempsey |
| 2,895,368 | A | | 7/1959 | Trigg, Jr. et al. |
| 3,122,406 | A | | 2/1964 | Modrey |
| 3,238,731 | A | | 3/1966 | Seifert et al. |
| 3,244,055 | A | * | 4/1966 | Schuermann et al. ..... 411/378 |
| 3,342,097 | A | | 9/1967 | Rocheleau |
| 3,561,260 | A | | 2/1971 | Reynolds |

(Continued)

OTHER PUBLICATIONS

Hardware Catalog—dated Aug. 2007.

(Continued)

*Primary Examiner* — Tara M. Pinnock
(74) *Attorney, Agent, or Firm* — Ohlandt, Greeley, Ruggiero & Perle, L.L.P.

(57) ABSTRACT

A method for attaching a plate to an interior of an underground excavation, the method comprising: placing a first surface of the plate adjacent to the interior of the excavation, the plate having at least one through a passageway disposed within the plate; forming a mounting hole within the excavation in alignment with the passageway; inserting a bolt from a second surface of the plate opposite the first surface through the passageway and into the mounting hole; the bolt having a dome portion being integrally attached to a washer portion, such that the dome portion extends in a convex manner away from the first side of the washer portion; and a driver connected to the dome portion; driving the bolt into through the passageway and the mounting hole by means of the driver; and securing the bolt to the mounting hole disposed within the excavation via an anchorage device, adhesive or grout.

5 Claims, 4 Drawing Sheets

(56) References Cited

U.S. PATENT DOCUMENTS

| | | | | | |
|---|---|---|---|---|---|
| 3,584,667 | A | | 6/1971 | Reiland | |
| 3,656,396 | A | | 4/1972 | Gutshall | |
| 3,823,639 | A | | 7/1974 | Liber | |
| 3,899,893 | A | * | 8/1975 | Banerjee et al. | 405/259.1 |
| 3,987,699 | A | | 10/1976 | Popenoe | |
| 4,018,132 | A | | 4/1977 | Abe | |
| 4,023,225 | A | | 5/1977 | Tochilkin et al. | |
| 4,091,853 | A | | 5/1978 | Buhl | |
| 4,122,681 | A | | 10/1978 | Vass et al. | |
| 4,149,446 | A | | 4/1979 | Spengler et al. | |
| 4,162,133 | A | | 7/1979 | Clark et al. | |
| D254,232 | S | | 2/1980 | Ono | |
| 4,193,715 | A | | 3/1980 | Vass | |
| 4,194,858 | A | | 3/1980 | Evans | |
| 4,229,875 | A | | 10/1980 | Crispell | |
| 4,293,243 | A | * | 10/1981 | Graybeal et al. | 405/259.1 |
| 4,295,761 | A | * | 10/1981 | Hansen | 405/259.6 |
| 4,299,515 | A | | 11/1981 | Yates et al. | |
| 4,310,266 | A | | 1/1982 | Malsbury et al. | |
| 4,410,296 | A | | 10/1983 | Unrug | |
| 4,419,805 | A | | 12/1983 | Calandra, Jr. | |
| 4,460,300 | A | | 7/1984 | Bettini et al. | |
| 4,492,500 | A | | 1/1985 | Ewing | |
| 4,518,292 | A | | 5/1985 | Calandra, Jr. | |
| 4,534,679 | A | | 8/1985 | White et al. | |
| 4,759,672 | A | | 7/1988 | Nilsen et al. | |
| 4,764,055 | A | | 8/1988 | Clark et al. | |
| 4,773,272 | A | | 9/1988 | Trungold | |
| 4,793,319 | A | | 12/1988 | Vaughan et al. | |
| 4,859,118 | A | | 8/1989 | Schaeffer | |
| 5,033,910 | A | | 7/1991 | Wright | |
| 5,064,312 | A | | 11/1991 | Calandra et al. | |
| 5,127,769 | A | | 7/1992 | Tadolini et al. | |
| 5,205,176 | A | | 4/1993 | Kibblewhite | |
| 5,641,258 | A | | 6/1997 | Sala | |
| 5,729,952 | A | | 3/1998 | Dahl | |
| 5,743,678 | A | | 4/1998 | Pitre | |
| 5,799,528 | A | | 9/1998 | Camping | |
| 5,878,488 | A | | 3/1999 | Muirhead | |
| 6,264,414 | B1 | | 7/2001 | Hartmann et al. | |
| 6,296,429 | B1 | * | 10/2001 | Wright | 411/5 |
| 6,497,024 | B2 | | 12/2002 | Fulbright | |
| 6,578,512 | B2 | | 6/2003 | Truax | |
| 6,582,171 | B2 | | 6/2003 | Bondarowicz et al. | |
| 6,808,120 | B2 | | 10/2004 | Oram et al. | |
| 6,872,041 | B2 | | 3/2005 | Lohr | |
| 6,991,547 | B2 | | 1/2006 | Dever et al. | |
| 7,044,688 | B2 | | 5/2006 | Dever et al. | |
| 7,232,283 | B2 | | 6/2007 | Dill et al. | |
| 7,438,513 | B2 | | 10/2008 | Craven et al. | |
| 7,632,045 | B2 | * | 12/2009 | Wu et al. | 405/259.1 |
| 7,658,581 | B2 | | 2/2010 | Suessenbach | |
| 2006/0159545 | A1 | | 7/2006 | Humpert et al. | |

OTHER PUBLICATIONS

Fastener Standards publication, copyright 1970.

Standard Specification for Roof and Rock Bolts and Accessories; Designation F432-04; ASTM.

Standard Test Methods for Determining the Mechanical properties of Externally and Internally Threaded Fasteners, Washers and Rivets; ASTM Designation F606-90.

* cited by examiner

METHOD OF USING A DOME HEADED ROOF BOLT

CROSS-REFERENCED APPLICATION

This application is a continuation application and claims priority to U.S. patent application Ser. No. 12/008,500, filed on Jan. 11, 2008, all of which is incorporated herein in its entirety.

BACKGROUND

1. Field of the Disclosure

The present version of these embodiments relate generally to the field of head designs for bolts or fasteners and more particularly to roof bolts or fasteners used in mining and tunneling underground.

2. Discussion of the Background Art

These embodiments relate to head designs for roof bolts, and more particularly to a novel head design for the head of bolts used generally in mines and underground digging. Generally when digging underground for mining and other purposes, the roof can become unstable and a many methods have been used to reinforce the roof or ceiling. The roof becomes unstable because the material for the tunnel has been removed. The material above the ceiling can cause the ceiling to crack and fall causing collapse of the tunnel. Many methods to reinforce the ceiling have been developed and practiced to help overcome this potentially dangerous problem.

One method of reinforcing the roof involves drilling a hole into the ceiling and inserting a bolt or rod with plate adjacent to the head to reinforce the ceiling. The shaft of the bolt can be threaded or have ribs along the length of the shaft and some shafts are smooth. The bolt head generally has some type of standard head design so that tools and equipment can attach to the head and drive the bolt. There is a washer element between the bead of the bolt and the shaft. The bolt can be very long depending upon the type of material in the ceiling. Miners and underground excavators like to see certain types of material in the ceiling above the tunnels so that bolls and plates can be most effective. Many times the preferred rock material for retaining the shaft to the rock is several feet from the ceiling, in some cases 6-8 feet or even more.

The bolt can be retained in the bole with the threads, with a mechanical anchorage device or can have a grout or adhesive that is inserted at various distances from the head or ceiling but generally at the top end of the hole. The distance for placement of the adhesive is determined by the type of rock that is found along the length of the hole. The adhesive can be placed at some appropriate distance from the head depending upon the type of material found at various elevations above the ceiling.

Many methods have been developed for securing the bolt in the hole. One method involves threaded rods and another involves two part adhesives. Another method involves pumping adhesives or grout through a bole in the shaft of the bolt. The two part adhesives are generally assembled in a separated two part cartridge which can be inserted into the hole before the bolt shah or along with the bolt shaft. When the bolt shaft is installed, the shaft is spun and this breaks the separation of the two materials in the cartridge and mixes them. The spinning of the bolt causes the adhesive to mix which results in a chemical reaction and results in the binding of the shaft to the rock with the adhesive. An upward force can also he given to the bolt head such that when the adhesive solidifies there is an upward force on the ceiling or the bolt is in tension.

The bolt or rod generally has a plate located adjacent to the washer element of the head of the bolt to disperse the loading of the bolt, head, washer and plate over the surface area of the ceiling adjacent to the plate. The bolt is installed so that the plate is as Slush with the ceiling as is possible. The bolt can then be forced upwards to create a tension in the bolt or various other methods have been developed to turn the bolt into the ceiling to tension the bolt. Other methods to tension the bolt either before and after the bolt has been inserted are known in the art. This loading from the bolt, head and washer is transferred to the plate and to the ceiling which compresses the ceiling to support the rock above the ceiling to deter collapse.

There are standards for the design and testing of roof bolts, shafts and heads, some of which are found in ASTM Designation F 432-04 "Standard Specifications for Roof and Rock Bolts and Accessories" and ASTM Designation F 606-90 "Standard Test Methods for Determining the Mechanical Properties of Externally and Internally Threaded Fasteners, Washers and Rivets".

These standards specify tests to ascertain the minimum loading to which the roof bolts, heads, shafts and plates should withstand. While the products on the market generally meet the tests designed for roof bolts, failures still occur in the real world.

The applicant has seen cases where the washers of the bolt heads become loaded in an unbalanced manner. This is due to the fact that many times the holes in the ceiling are not drilled straight or the ceiling surface is not perpendicular to the holes and plate thereby does not sit parallel and adjacent to the ceiling surface. Other times the bolt is not driven exactly concentric to the hole center line when installed.

When any of these conditions occur, the washer is loaded at the washer plate interface more on one side of the washer than the other. When the load becomes too great, the washer regularly fails and this condition can result in failure of the head and shaft too. Subsequently, the plates can fall away from the ceiling. Failure of the bolt or plate support can result in the loss of ground support, ceiling dropping and possible collapse. If repair is possible it can be extremely costly. Work can stop until the tunnels or digging can be made safe from ceiling collapse.

While these bolts do meet the specifications for roof bolts, failures still occur. In other cases where the bolt load is perpendicular to the washer and plate in the ceiling, these bolts still fail at the washer head interface when the washers concave towards the head end of the bolt or shear from the bolt. The plate then fractures, bends or detaches from the holt head resulting in the ceiling lowering or possible collapse.

Applicants sought to change the head design to help prevent the failure of the bolt heads at the washer head interface and washer shaft interface. Applicant has modified the area on the shaft directly below the washer arid modified the head between the head end and the washer.

Testing has been performed and it has been found that these new embodiments are stronger by as much as 60% over the roof holt head designs in the background art.

For the foregoing reasons, there is a need for a new roof bolt head design or a dome headed roof bolt.

SUMMARY

In view of the foregoing disadvantages inherent in the background art of ceiling or roof bolts them is a need for a dome headed roof bolt.

A first objective of these embodiments is to provide a roof bolt that is stronger than the background art.

Another objective of these embodiments is to provide a device that can be installed in the same manner as the background art.

It is yet another objective of these embodiments to provide a device that has increased strength between the shaft and the washer.

It is a still further objective of these embodiments to provide a device that has increased strength between the washer and the driver.

An additional objective of these embodiments is to provide a device that is less likely to fail with offset loading of the bolt and bolt head.

These together with other objectives of these embodiments, along with various features of novelty which characterize these embodiments, are pointed out with particularity in the claims annexed hereto forming a part of this disclosure. For a better understanding of these embodiments, their operating advantages and the specific objectives attained by their uses, reference should be had to the accompanying drawings and descriptive matter in which there is illustrated a preferred embodiment.

DETAILED DESCRIPTION OF THE PREFERRED EMBODIMENT

Figure 1:
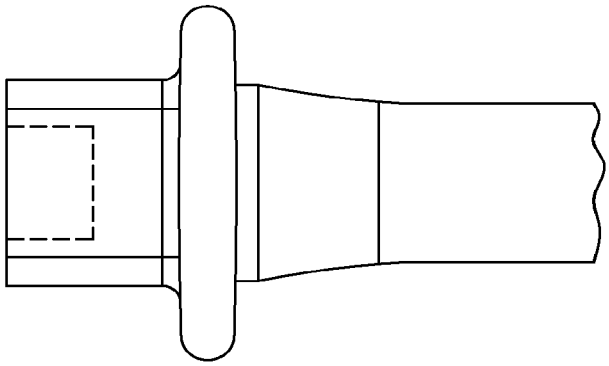
FIG. 1 (Prior Art)
FIG. 1 shows a side view of a typical background art roof bolt.

Referring to the drawings in detail wherein like elements are indicated by like numerals, there is shown in FIG. 1 a side view of typical background art roof bolt. As can be seen, this embodiment has a diameter between the shaft and the washer that is approximately parallel to the shaft. The washer has parallel sides and the interlace between the top of the washer and the head end has a small chamfer.

Figure 2:
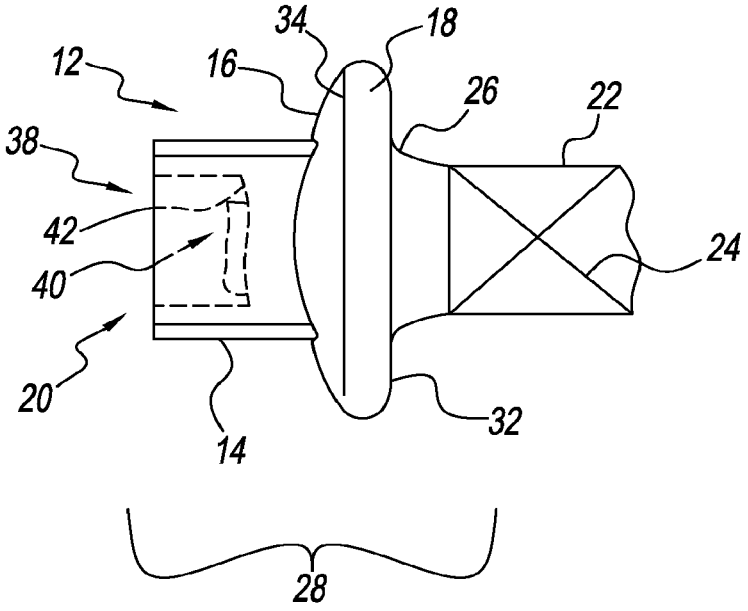
FIG. 2 shows a side view of one embodiment of the applicant's dome headed roof bolt.

FIG. 2 shows one embodiment of the applicant's roof bolt 12. Applicant's bolt 12 has a shaft 22 with ribs 24. Applicant's bolt 12 shaft 22 could also have threads or the shaft 22 could have a smooth surface finish (not shown). On one end of the shaft 22 is the head 28 and head end 20. It should be understood that applicant's head 28 design could he utilized on other types of bolts 12.

Between the shaft 22 and the washer 18 is an annular radius 26. Annular radius 26 helps distribute any tensile loading of the shaft 22 to the washer 18. As can be seen in FIG. 1, the background art has a relatively constant diameter section immediately between the shaft and the washer and this causes loading over a smaller diameter of the washer as compared to the loading that occurs with applicant's annular radius 26. Applicant's washer 18 can be thicker than the background art also. The background art allows a stress concentration to occur between the shaft and washer and this is where the failure typically occurs.

Figure 3:
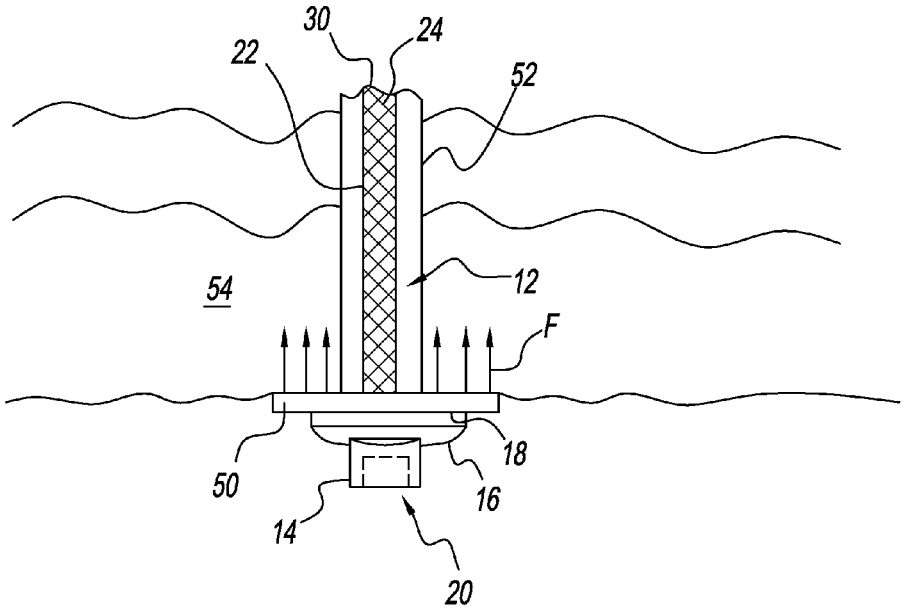
FIG. 3 shows a side view of one embodiment of the applicant's bolt installed in the ceiling with a plate.
Figure 4:
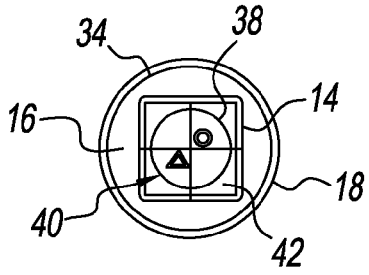
FIG. 4 shows a top view of one embodiment of the head end of the bolt with indicia.
Figure 5:
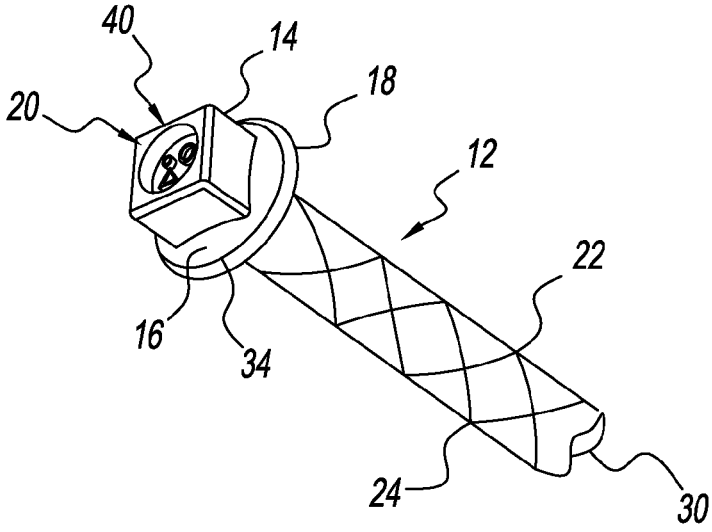
FIG. 5 shows a top perspective view of one embodiment of the bolt.
Figure 6:
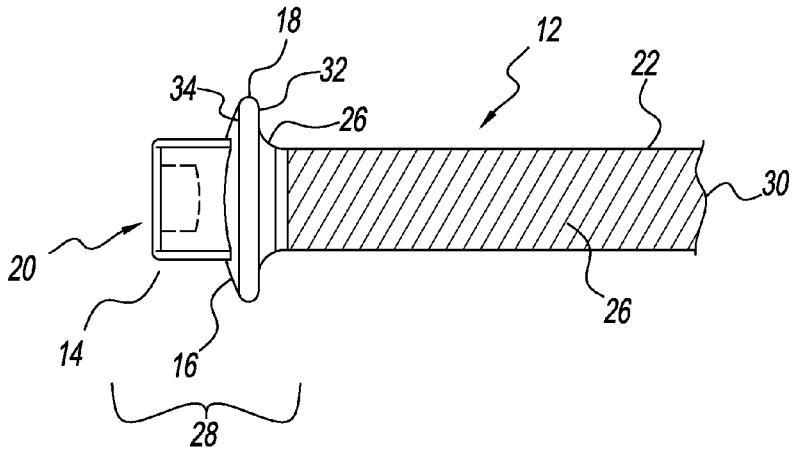
FIG. 6 shows a side view of one embodiment of the bolt.
Figure 7:
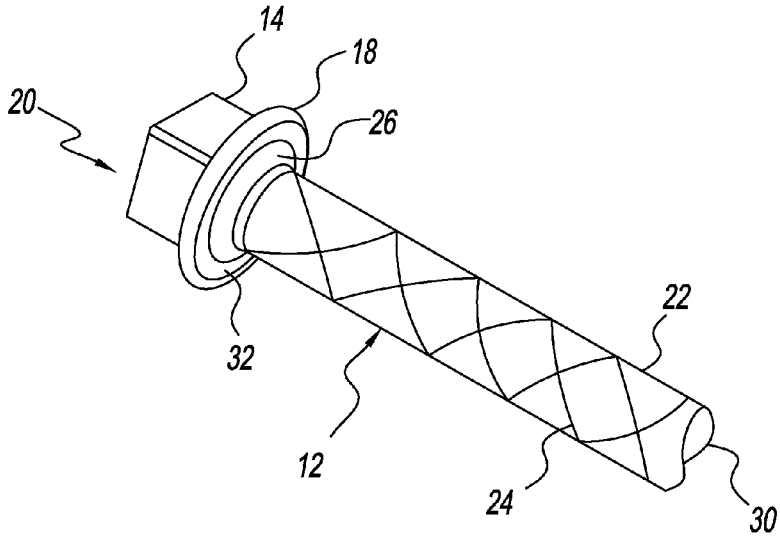
FIG. 7 shows a bottom perspective view of one embodiment of the bolt.

FIG. 2 shows that between the washer 18 and the driver 14 is a dome 16. The dome 16 angles from the washer 18 to the driver 14 in a concave shape towards the head end 20. The driver 14 is used to install the bolt 12 into the hole 52 in the rock 54, FIG. 3. The driver 14 can also have a hole 38 with a surface 42 for marking indicia 40 indicating various parameters and physical characteristics of the bolt 12 as is web known in the art, FIGS. 4, 5.

To install the bolt 12, the user drills a hole 52 in the rock 54 to a certain depth dependent upon the makeup of the rock 54 found in the bole 52. Generally softer rock 54 requires a deeper hole 52, FIG. 3.

When the hole 52 is drilled to the appropriate depth, the user places a plate 50 over the shaft end 30 of the bolt 12 and slides the plate 50 to the first side 32 of washer 18. A tool can then be placed on the head end 20 of the holt 12, the shaft end 30 is inserted into the hole 52 in rock 54. A mechanical anchorage device, or adhesive can also be inserted into hole 52 along with the bolt 12 or can be placed prior to the insertion of the bolt 12 depending upon the specific retention method employed by the user.

The driver 14 is generally turned and either the mechanical anchorage device or adhesive secures the shaft 22 to the interior of the hole 52. The plate 50 is secured against the ceiling rock 54 either via the various mechanical anchorage devices, adhesives or grout that secures the shaft 22 to the interior of the hole 52. This places the bolt 12 and plate 50 under load to help secure the rock 54 in the direction of force F, FIG. 3.

The end result of this installation is that the bolt 12 and plate 50 secure the ceiling in an upwards direction in the direction of force F to secure the rock 54 and help prevent collapse of the ceiling into the tunnel and excavated area.

It should be noted that while this discussion focuses on retaining ceiling rock 54, this device could also be used to secure side walls of an excavation.

The applicant's dome headed roof bolt 12 provides better retention of the bolt 12 in the rock 54. Background art when loaded would often fail at the head, primarily the washer shaft interface. Applicant has added an annular radius 26 to the shaft 22, between the shaft 22 and the first side 32 of the washer 18. The diameter of the annular radius 26 is less than the diameter of the washer 18. This radius 26 better distributes the tensile loading that occurs in the shaft 22 and in transferring the load to the head 28. This radius 26 also increases the strength of the shaft 22 and washer 18 interface when the bolt 12 is not loaded in a purely tensile condition or the bolt has a bending condition. This bending condition can result from the bolt hole 52 not being drilled perpendicular to the ceiling. This non-perpendicular hole 52 condition can be due to the drilling in different layers of rock 54 and the bit wandering. This bending condition can also result from irregularities in the surface of the ceiling where the plate 50 is secured. It is also possible that the shaft 22 of the bolt 12 will not be installed in the center of the hole 52. These conditions can cause uneven loading of the washer 18, plate 50 and ceiling resulting in stress concentrations in the washer 18 and head 28 of bolt 12.

Applicant has also added a circular dome 16 to the second side 34 of the washer 18. This dome 16 has a concave shaped surface extending from the second side 34 of the washer 18 towards the head end 20 of the bolt 12. The driver 14 is connected to the dome 16. This dome 16 also increases the strength of the bolt 12 when the bolt 12 is in tension and increases the strength of the bolt 12 when the bolt is not in a purely tensile condition. The dome 16 tends to increase the strength of the connections between the radius 26, washer 18, dome 16 and driver 14. The dome 16 discourages the washer 18 from failing in pure tension and the non-linear loading condition.

It will now be apparent to those skilled in the art that other embodiments, improvements, details and uses can be made consistent with the letter and spirit of the foregoing disclosure and within the scope of this application, which is limited only by the following claims, construed in accordance with the patent laws, including the doctrine of equivalents.

What is claimed is:

1. A method for attaching a plate to an interior of an underground excavation, said method comprising:

placing a first surface of said plate adjacent to said interior of said excavation, said plate having at least one passageway disposed within said plate;

forming a mounting hole within said excavation in alignment with said passageway;

inserting a bolt from a second surface of said plate opposite said first surface through said passageway and into said mounting hole; said bolt comprising:

a shaft comprising a terminal end and an end opposite said terminal end, said opposite end terminating in an annular radius, a washer portion having first and second sides, said first side of said washer portion being integrally attached to said annular radius and disposed directly adjacent and abutting said second surface of said plate;

a dome portion being integrally attached to said second side of said washer portion, such that said dome portion extends in a convex manner away from said first side of said washer portion; and a driver connected to said dome portion;

wherein said annular radius has a radius of curvature and said dome portion extends in a convex manner along a radius of curvature away from said driver, and wherein said radius of curvature of said annular radius is less than said radius of curvature of the dome portion;

driving said bolt into through said passageway and said mounting hole by means of said driver; and securing said shaft of said bolt to said mounting hole disposed within said excavation via an anchorage device, adhesive or grout.

2. The method according to claim 1, wherein said bolt further comprises ribs extending along said shaft from substantially near annular radius to substantially near said terminal end.

3. The method according to claim 1, wherein said bolt further comprises threads located on said shaft between said annular radius and said terminal end.

4. The method according to claim 1, wherein said bolt further comprises a smooth shaft surface with no ribs.

5. The method according to claim 1, wherein said bolt is secured to said excavation by rock that is between about 6 to about 8 feet from a ceiling of said excavation.

* * * * *